US007001070B2

(12) United States Patent
Kendall et al.

(10) Patent No.: US 7,001,070 B2
(45) Date of Patent: Feb. 21, 2006

(54) X-RAY TUBE COOLANT VOLUME CONTROL SYSTEM

(75) Inventors: Charles B. Kendall, Brookfield, WI (US); Clarence L. Gordon, III, Delafield, WI (US)

(73) Assignee: General Electric Company, Schnectady, NY (US)

( * ) Notice: Subject to any disclaimer, the term of this patent is extended or adjusted under 35 U.S.C. 154(b) by 71 days.

(21) Appl. No.: 10/707,710

(22) Filed: Jan. 6, 2004

(65) Prior Publication Data

US 2005/0147208 A1 Jul. 7, 2005

(51) Int. Cl.
*H01J 35/10* (2006.01)

(52) U.S. Cl. ..... 378/200

(58) Field of Classification Search ..... 378/141, 378/130, 199–202
See application file for complete search history.

(56) References Cited

U.S. PATENT DOCUMENTS 5,222,118 A * 6/1993 Gerth ..... 378/200

* cited by examiner

*Primary Examiner*—Craig E. Church
(74) *Attorney, Agent, or Firm*—Peter J. Vogel

(57) ABSTRACT

An imaging tube coolant volume control system (14) for an imaging tube (18) includes a compensation tank (80) that is configured to fluidically couple an imaging tube cooling circuit (11). The compensation tank (80) includes a cooling fluid (17) and a compensation-dividing member (100). The member (100) is adjustable in response to the change in volume of the cooling fluid (17). An overflow vessel (82) is fluidically coupled to the compensation tank (80). A compensation valve (86) is coupled between the compensation tank (80) and the overflow vessel (82) and allows flow of the cooling fluid between the compensation tank (80) and the overflow vessel (82) when pressure of the cooling fluid (17) is greater than or equal to a first predetermined pressure level.

20 Claims, 2 Drawing Sheets

X-RAY TUBE COOLANT VOLUME CONTROL SYSTEM

BACKGROUND OF INVENTION

The present invention relates generally to thermal energy management systems and cooling circuits within electron beam generating devices and systems. More particularly, the present invention relates to a system for controlling coolant volume size within an x-ray tube.

A computed tomography (CT) imaging system typically includes a gantry that rotates at various speeds in order to create a 360° image. The gantry contains a CT tube, which generates x-rays across a vacuum gap between a cathode and an anode. In order to generate the x-rays, a large voltage potential is created across the vacuum gap, which allows electrons to be emitted, in the form of an electron beam. The electron beam is emitted from the cathode to a target on the anode. In releasing of the electrons, a filament contained within the cathode is heated to incandescence by passing an electric current therein. The electrons are accelerated by the high voltage potential and impinge on the target, where they are abruptly slowed down to emit x-rays. The high voltage potential produces a large amount of heat within the CT tube, especially within the anode.

The vacuum vessel is typically enclosed in a casing filled with circulating cooling fluid, such as dielectric oil. The cooling fluid often performs two duties: cooling the vacuum vessel, and providing high voltage insulation between the anode and the cathode. The cooling fluid in cooling the vacuum vessel maintains temperatures thereof and components contained therein. The temperature maintenance of the CT tube aids in the prevention of image artifacts, as well as increasing the life of the CT tube components.

The cooling fluid within the CT tube typically has a high coefficient of thermal expansion (CTE). In other words, the cooling fluid volume of the fluid can increase and decrease significantly with change in temperature. Currently a moveable diaphragm is used to compensate for the expansion of the cooling fluid. For CT imaging systems that use a separate heat exchanger for the CT tube, during a CT tube maintenance replacement, the cooling fluid volume can become maladjusted when the CT tube and corresponding cooling circuit is at an elevated temperature.

When a CT tube is replaced, the replacement CT tube and the cooling fluid contained therein are at room temperature. The CT tube being replaced is typically at a temperature above room temperature. Although, the volume of the cooling fluid within the replacement CT tube is approximately the same as the volume of the cooling fluid within the CT tube being replaced, the actual amount of room temperature fluid in the replacement tube is greater than that of the CT tube being replaced. Thus, the replacement in effect increases the amount of fluid within the cooling circuit. This increase in the amount of fluid can be as much as one third of a liter, which upon heating of the replacement CT tube can result in the fluid volume expanding beyond a mechanical limit of the diaphragm. The expansion beyond the mechanical limit creates an overpressure situation within the cooling circuit. This overpressure situation can cause the cooling circuit to operate inappropriately and eventually cause the system to become inoperable.

Thus, there exists a need for a CT tube cooling circuit or associated system that is capable of accounting for a change in cooling fluid volume upon replacement or maintenance of a CT tube.

SUMMARY OF INVENTION

The present invention provides an imaging tube coolant volume control system for an imaging tube that includes a compensation tank, which is configured to fluidically couple an imaging tube cooling circuit. The compensation tank includes a cooling fluid and a compensation-dividing member. The member is adjustable in response to the change in the volume of the cooling fluid. An overflow vessel is fluidically coupled to the compensation tank. A compensation valve is coupled between the compensation tank and the overflow vessel and allows flow of the cooling fluid between the compensation tank and the overflow vessel when pressure of the cooling fluid is greater than or equal to a first predetermined pressure level.

The embodiments of the present invention provide several advantages. One such advantage that is provided by multiple embodiments of the present invention is the provision of an imaging tube coolant volume control system having a compensation tank and an overflow vessel. The operational combination of which compensates for a volume expansion and an increase in the amount of a cooling fluid within an imaging tube and associated cooling circuit. In so doing, the volume of the cooling fluid is maintained within the imaging tube even during maintenance or replacement thereof, which aids in maintaining proper operation and increasing service life of imaging system components and systems.

Another advantage that is provided by multiple embodiments of the present invention is the provision of an imaging tube coolant volume control system having multiple pressure compensation, relief, and switching devices for improved cooling fluid volume control within an imaging tube and imaging system protection. This further maintains proper operation and increases service life of imaging system components and systems.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein.

DETAILED DESCRIPTION

Figure 1:
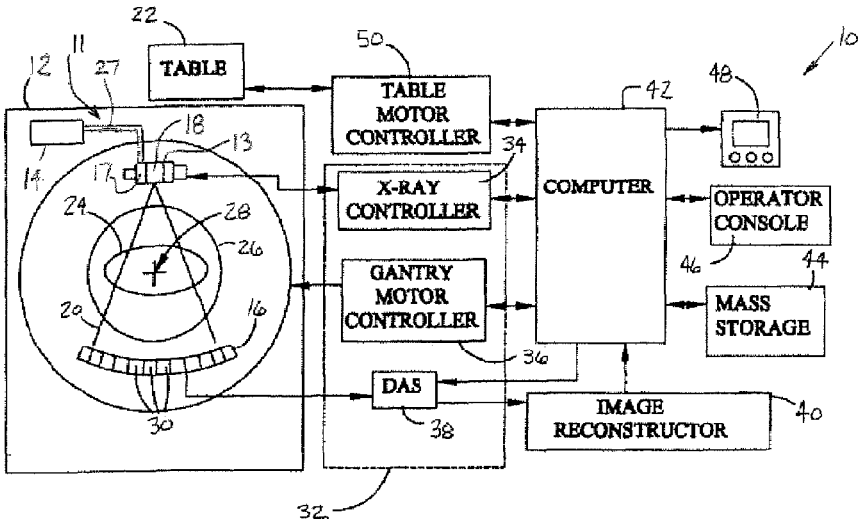
FIG. 1 is a schematic block diagrammatic view of a computed tomography imaging system utilizing a CT tube cooling circuit having an imaging tube coolant volume control system in accordance with an embodiment of the present invention.

In the following figures, the same reference numerals will be used to refer to the same components. While the present invention is described with respect to system for controlling coolant volume within a computed tomography (CT) tube, the following apparatus and method is capable of being adapted for various purposes and is not limited to the following applications: magnetic resonance imaging (MRI) systems, CT systems, radiotherapy systems, flouroscopy systems, X-ray imaging systems, ultrasound systems, vascular imaging systems, nuclear imaging systems, magnetic resonance spectroscopy systems, and other applications known in the art where maintenance of a cooling fluid volume is desired. The present invention may apply to x-ray tubes, CT tubes, or other imaging tubes known in the art.

In the following description, various operating parameters and components are described for one constructed embodiment. These specific parameters and components are included as examples and are not meant to be limiting.

Referring now to FIG. 1, a schematic block diagrammatic view of a computed tomography imaging system 10 utilizing a CT tube cooling circuit 11 in accordance with an embodiment of the present invention is shown. The imaging system 10 includes a gantry 12 that has the cooling circuit 11, with a CT tube assembly 13 and an imaging tube coolant volume control system 14, and a detector array 16. The volume control system 14 maintains volume of a cooling fluid 17 within an x-ray generating device or CT tube 18 of the CT tube assembly 13. The tube 18 projects a beam of x-rays 20 towards the detector array 16. The detector array 16 and the tube 18 rotate about an operably translatable table 22. The table 22 is translated along a z-axis between the CT tube assembly 13 and the detector array 16 to perform a helical scan. The beam 20 after passing through a medical patient 24, within a patient bore 26, is detected at the detector array 16. The detector array 16 upon receiving the beam 20 generates projection data that is used to create a CT image.

The volume control system 14 is utilized by the cooling circuit 11 to maintain volume of the cooling fluid 17 within the CT tube 18. The volume control system 14 is coupled to the CT tube 18 via an expansion tube 27. Of course, the volume control system 14 may be coupled to the CT tube 18 directly or using other techniques known in the art. The volume control system 14 compensates for volume expansion and contraction of the cooling fluid 17 during operation of the CT tube 18, caused by change in operating temperature of the CT tube 18 and thus the cooling fluid 17. This is described in further detail below. The volume control system 14 may be located within the gantry 12 as shown, or may be in various other locations known in the art.

The cooling fluid 17 has a contracted volume and an expanded volume. The contracted volume refers to when the cooling fluid is in a relatively cold temperature state, such as at room temperature. During normal operating conditions, the cooling fluid 17 has a normal operational expansion volume, which may be referred to as the expanded volume. The cooling fluid 17 may be in the form of dielectric oil, or other fluids, such as water and air.

The CT tube 18 and the detector array 16 rotate about a center axis 28. The beam 20 is received by multiple detector elements 30. Each detector element 30 generates an electrical signal corresponding to the intensity of the impinging x-ray beam 20. As the beam 20 passes through the patient 24 the beam 20 is attenuated. Rotation of the gantry 12 and the operation of tube 18 are governed by a control mechanism 32. The control mechanism 32 includes an x-ray controller 34 that provides power and timing signals to the tube 18 and a gantry motor controller 36 that controls the rotational speed and position of the gantry 12. A data acquisition system (DAS) 38 samples analog data from the detector elements 30 and converts the analog data to digital signals for subsequent processing. An image reconstructor 40 receives sampled and digitized x-ray data from the DAS 38 and performs high-speed image reconstruction. A main controller or computer 42 stores the CT image in a mass storage device 44.

The computer 42 also receives commands and scanning parameters from an operator via an operator console 46. A display 48 allows the operator to observe the reconstructed image and other data from the computer 42. The operator supplied commands and parameters are used by the computer 42 in operation of the DAS 38, the x-ray controller 34, and the gantry motor controller 36. In addition, the computer 42 operates a table motor controller 50, which translates the table 22 to position patient 24 in the gantry 12.

The x-ray controller 34, the gantry motor controller 36, the image reconstructor 40, the computer 42, and the table motor controller 50 may be microprocessor-based such as a computer having a central processing unit, memory (RAM and/or ROM), and associated input and output buses. The x-ray controller 34, the gantry motor controller 36, the image reconstructor 40, the computer 42, and the table motor controller 50 may be a portion of a central control unit or may each be stand-alone components as shown.

Figure 2:
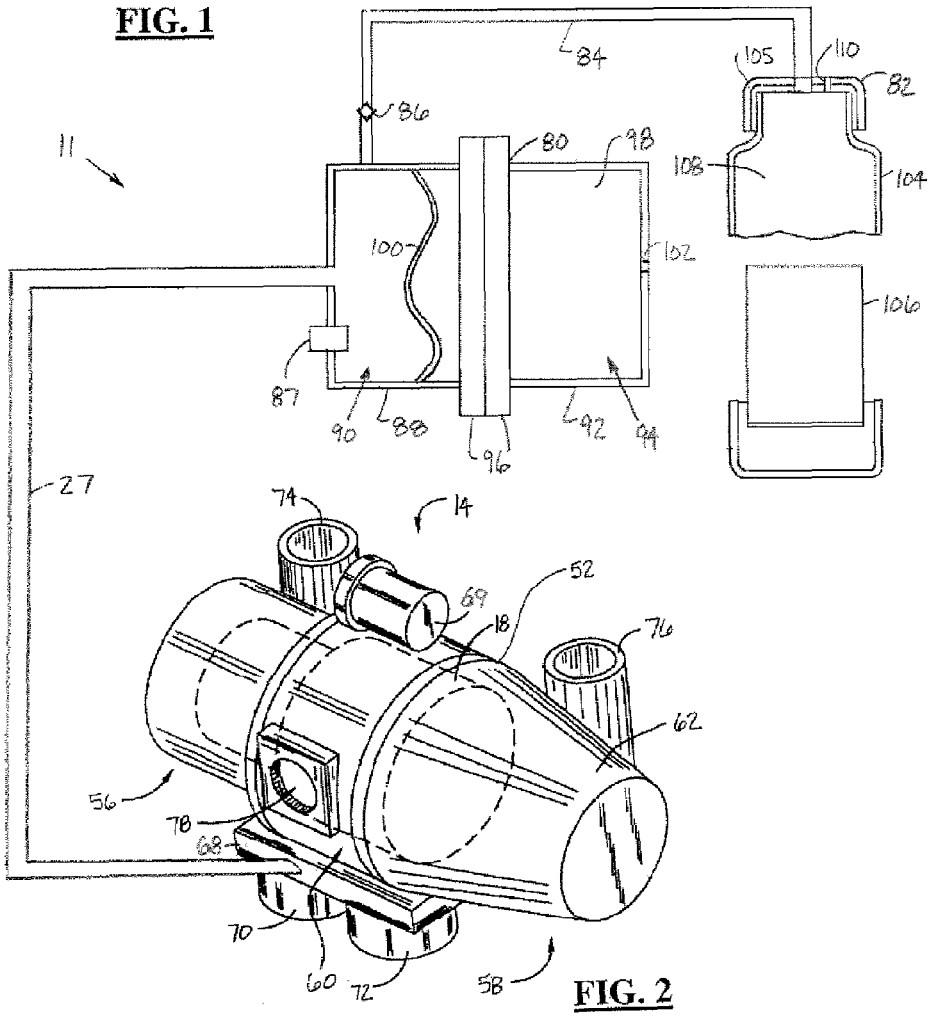
FIG. 2 is a perspective view of the CT tube cooling circuit of FIG. 1 in accordance with an embodiment of the present invention.

Referring now to FIG. 2, a perspective view of the CT tube cooling circuit 11 is shown in accordance with an embodiment of the present invention. As stated above, the cooling circuit 11 includes the CT tube assembly 13 and the volume control system 14.

The tube assembly 13 includes the CT tube 18 with a housing unit 52 and having an anode end 56, a cathode end 58, and a center section 60. The center section 60 is positioned between the anode end 56 and the cathode end 58. The x-ray tube 18 is enclosed in a fluid chamber or vessel 62. The chamber 62 is typically filled with the cooling fluid 17. The cooling fluid 17 circulates through housing 52 to cool the x-ray tube 18 and may insulate the vessel 62 from the high electrical charges within the x-ray tube 18. The tube assembly 13 also includes a radiator or heat exchanger 68 and a coolant pump 69 for cooling of the CT tube 18.

The heat exchanger 68 is positioned to one side of the center section 60 and cools the cooling fluid 17. The heat exchanger 68 may have fans 70 and 72 operatively connected to the heat exchanger 68, which provide airflow over the heat exchanger 68. The pump 69 is provided to circulate the cooling fluid 17 through the cooling assembly 11, the housing 52, and the heat exchanger 68. Electrical connections, for communication with the x-ray tube 18, are provided through an anode receptacle 74 and a cathode receptacle 76. A casing window 78 is provided for x-ray emission from the vessel 62.

The volume control system 14 is coupled to the heat exchanger 68 via the expansion tube 27. The volume control system 14 includes a compensation tank 80 and an overflow vessel 82. The compensation tank 80 is coupled to the CT tube 18 by the expansion tube 27. The overflow vessel 82 is coupled to the compensation tank 80 by an overflow tube 84. The volume control system 14 also includes a compensation valve 86 and a pressure switch 87, which are utilized in operable fluid control of the system. The pressure switch 87 may be electrically coupled to the x-ray controller 34.

The compensation tank 80 includes a first half 88 having a cooling fluid side 90 and a second half 92 having a relief fluid side 94. Although the halves 88 and 92 are shown as being coupled to each other via the flanges 96, other coupling techniques known in the art may be utilized. The halves 88 and 92 may be integrally molded into a single unit. The cooling fluid side 90 is generally filled with the cooling fluid 17 and the relief fluid side 94 is generally filled with a relief fluid 98. In one embodiment of the present invention, the cooling fluid side 90 is positioned above the CT tube 18 and oriented such that cooling fluid 17 may freely enter and return from the cooling fluid side 90 during expansion and contraction of the cooling fluid 17.

The internal volume of the relief fluid side 94 is greater than or approximately equal to the normal operational expansion volume of the cooling fluid 17. This allows the expanded volume of the cooling fluid 17 to fill the compensation tank 80 and increase the volume of the cooling fluid side 90. As the temperature of the cooling fluid 17 increases, thus increasing the volume of the cooling fluid 17, a portion of the cooling fluid 17 enters the cooling fluid side 90 through release of the relief fluid 98 on the relief fluid side 94. In one embodiment of the present invention, the internal volume of the relief fluid side 94 is set equal to the normal operational expansion volume of the cooling fluid 17.

The relief fluid 98 may be in the farm of air, nitrogen, a pure gas, or some other relief fluid known in the art. A compensation-dividing member 100 resides between the cooling fluid side 90 and the relief fluid side 94. The dividing member 100 may be in the form of a diaphragm, a cup, or some other separating or dividing member. The dividing member may be flexible or rigid in nature and may be farmed of polyethylene, a high-density polyethylene, polytetrafluoroethylene, such as Teflon®, a plastic material, or other similar material, or a combination thereof.

The compensation tank 80 also includes a first pressure relief device 102 coupled to the second half 94. The first relief device 102 releases the relief fluid 98 from the tank 80 as the cooling fluid 17 enters the first half 90. The first relief device 102 may be in the form of a vent, a relief valve, or some other relief device known in the art.

The overflow vessel 82 includes an outer housing 104 having a threaded cap 105 and an overflow bag 106, which is contained therein. The outer housing 104 may be positioned above the cooling fluid side 90 and oriented such that the cooling fluid 17 within the cooling fluid side 90 may enter and return from the bag 106. The bag 106 is expandable to the internal volume of the housing 104. The internal volume of the housing 104 is greater than or approximately equal to the expansion volume of the relief fluid side 94 during cold temperature or imaging system start-up conditions. In one embodiment of the present invention, the expansion volume of the relief fluid side 94 is approximately 20 cubic inches and the internal volume of the housing 104 is approximately 24 cubic inches.

The overflow bag 106 may also be formed of polyethylene, a high-density polyethylene, Teflon®, a plastic material, or other similar material, or a combination thereof. The overflow vessel 82 contains a relief fluid 108, such as the relief fluid 98, which may be released through a second pressure relief device 110 as the cooling fluid 17 flows into the bag 106. The second pressure relief device 110 may also be in the form of a vent, a relief valve, or some other known relief device.

The compensation valve 86 is pressure sensitive. The compensation valve 86 allows flow of the cooling fluid 17 to the overflow vessel 82 when the pressure of the cooling fluid 17 is greater than or equal to a first predetermined value. Although the compensation valve 86 is shown as being coupled in series with the overflow tube 84 between the compensation tank 80 and the overflow vessel 82, the compensation valve 86 may be coupled directly to the compensation tank 80 or the overflow vessel 82, or may be coupled elsewhere. The compensation valve 86 may be in various valve forms known in the art.

The pressure switch 87 performs as a safety switch, such that when the overflow vessel 82 is filled with the cooling fluid 17 and/or when the pressure of the cooling fluid 17 increases to be greater than or equal to a second predetermined value, the switch 87 disables operation of the CT tube 18. The pressure switch 87 may also be used to disable other components or systems, as well as to inhibit operational tasks of the CT system 10 from being performed. The pressure switch 87 is coupled to and resides on the cooling fluid side 90. The pressure switch 87 may be mounted in various other locations, as long as it is capable of readily determining pressure of the cooling fluid 17.

Figure 3:
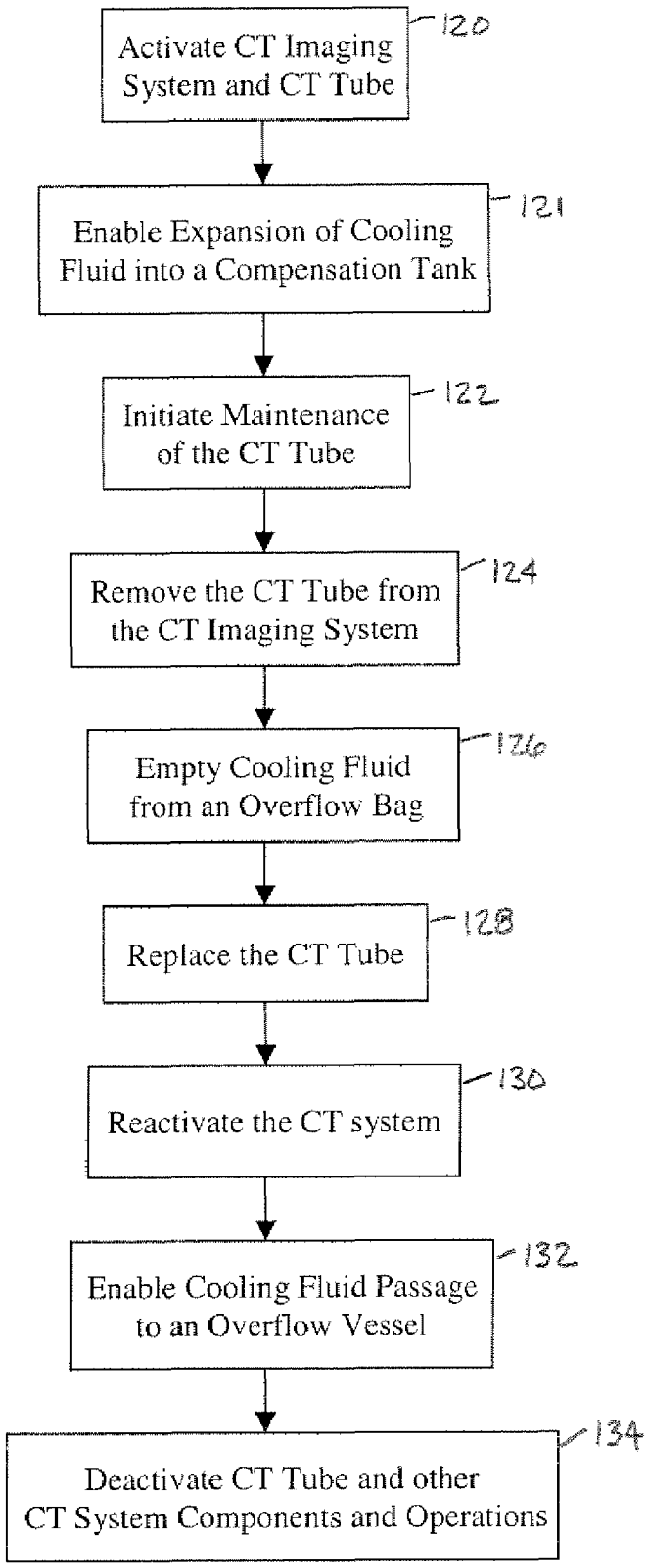
FIG. 3 is a logic flow diagram illustrating a method of compensating for change in volume of a cooling fluid within an imaging tube as applied to a CT tube maintenance procedure and in accordance with an embodiment of the present invention.

Referring now to FIG. 3, a logic flow diagram illustrating a method of compensating for change in volume of a cooling fluid 17 within the imaging tube 18 as applied to a CT tube maintenance procedure and in accordance with an embodiment of the present invention is shown.

In step 120, the CT system 10 and CT tube 18 are enabled such that the cooling fluid 17 "comes-up" to normal operating temperature and volume. In step 121, as the temperature of the cooling fluid 17 increases and as the volume of the cooling fluid 17 increases within the CT tube 18 beyond the allotted internal volume of the CT tube vessel 62, the cooling fluid 17 enters the cooling fluid side 90. This is further enabled through repositioning or expanding of the dividing member 100 in response to change in volume of the cooling fluid 17. As the dividing member 100 is adjusted and pressure within the relief side 94 increases, the first relief device 102 allows the relief fluid to be released from the compensation tank 80.

In step 122, it is determined that the CT tube 18 needs to be repaired or replaced. In step 124, the CT system 10 is disabled and the CT tube 18 is removed from the system 10. In step 126, the original CT tube 18 is repaired and reinstalled or a new CT tube is installed. In step 128, the bag 106 is removed from the overflow vessel 82 via the cap 105. Any cooling fluid within the bag 106 is removed therefrom. In step 130, the system is reactivated.

In step 132, the compensation valve 86 allows passage of the cooling fluid 17 into the bag 106. As the temperature of the cooling fluid 17 increases causing the volume of the cooling fluid 17 to increase beyond the allotted internal volume of the CT tube vessel 62 and beyond the allotted internal volume of the compensation tank 80, the cooling fluid 17 is allowed to pass into the overflow vessel 82. The compensation valve 86 opens as pressure of the cooling fluid 17 increases to be greater than that of the first predetermined value. In one example embodiment, the first predetermined value is approximately equal to 5 psi. When the pressure of the cooling fluid 17 is approximately 5 psi, the compensation valve 86 opens allowing the cooling fluid 17 to pass between the cooling fluid side 90 and the bag 106. As cooling fluid 17 enters the bag 106 the second relief device 110 releases the relief fluid 108 within the overflow vessel 82.

In step 134, in the event that the compensation tank 80 and the bag 106 are filled with the cooling fluid 17 and yet further expansion of the cooling fluid 17 is occurring, causing the pressure of the cooling fluid 17 to increase and be greater than or equal to that of the second predetermined value, the pressure switch 87 disables operation of the CT tube 18 and may also disable other desired components, systems, and system operations. In another example embodiment, the second predetermined value is set equal to approximately 10 psi.

The above-described steps are meant to be an illustrative example; the steps may be performed synchronously, simultaneously, sequentially, or in a different order depending upon the application. Also, although the above method is described with respect to a maintenance procedure, the method may be easily modified and applied such that it may be used during normal operating procedures or during other CT system related procedures known in the art.

The present invention provides an imaging tube coolant volume control system having a compensation tank and an overflow vessel, which allow for the normal operational expansion of cooling fluid within an imaging tube, as well as compensating for situations when an increased amount of cooling fluid is introduced into the system and further allotted cooling fluid expansion is desired. The present invention also provides increased operational safety of a CT tube and associated imaging system, as well as a cooling fluid volume control technique that may be utilized during various maintenance procedures.

The above-described apparatus and method, to one skilled in the art, is capable of being adapted for various applications and systems known in the art. The above-described invention can also be varied without deviating from the true scope of the invention.

What is claimed is:

1. An x-ray imaging tube coolant volume control system for an x-ray imaging tube comprising:

a compensation tank configured to fluidically couple an x-ray imaging tube cooling circuit and comprising;

a cooling fluid; and a compensation-dividing member adjustable in response to change in volume of said cooling fluid;

an overflow vessel fluidically coupled to said compensation tank; and a compensation valve coupled between said compensation tank and said overflow vessel and allowing flow of said cooling fluid between said compensation tank and said overflow vessel when pressure of said cooling fluid is greater than or equal to a first predetermined pressure level.

2. A system as in claim 1 wherein said compensation tank further comprises:

a cooling fluid side having said cooling fluid; and a relief fluid side having a relief fluid.

3. A system as in claim 1 wherein internal volume of said relief fluid side is greater than or approximately equal to a normal operational expansion volume of said cooling fluid.

4. A system as in claim 1 wherein said compensation tank further comprises:

a first half; and a second half coupled to said first half via a pair of flanges.

5. A system as in claim 1 wherein said overflow vessel comprises an overflow bag.

6. A system as in claim 5 wherein said overflow bag is formed of a material selected from at least one of a polyethylene, a high density polyethylene, polytetrafluoroethylene, and plastic.

7. A system as in claim 1 wherein said overflow vessel comprises a relief fluid.

8. A system as in claim 1 wherein internal volume of said overflow vessel is approximately equal to or greater than a normal operational expansion volume of said cooling fluid.

9. A system as in claim 1 wherein said first predetermined pressure level is approximately equal to 5 psi.

10. A system as in claim 1 further comprising a pressure switch preventing operation of at least a portion of an x-ray imaging system when pressure of said cooling fluid is greater than or equal to a second predetermined pressure level.

11. A system as in claim 1 further comprising a pressure relief device coupled to said compensation tank and relieving pressure of a relief fluid.

12. A system as in claim 11 wherein said pressure relief device is selected from at least one of a vent and a pressure relief valve.

13. A system as in claim 1 further comprising a pressure relief device coupled to said overflow vessel and relieving pressure of a relief fluid.

14. A system as in claim 13 wherein said pressure relief device is selected from at least one of a vent and a pressure relief valve.

15. An x-ray imaging tube cooling circuit comprising:

an x-ray imaging tube vessel; and an x-ray imaging tube coolant volume control system fluidically coupled to said x-ray imaging tube vessel and comprising;

a compensation tank configured to fluidically couple an x-ray imaging tube cooling circuit and comprising;

a cooling fluid; and a compensation-dividing member adjustable in response to change in volume of said cooling fluid;

an overflow vessel fluidically coupled to said compensation tank; and a compensation valve coupled between said compensation tank and said overflow vessel and allowing flow of said cooling fluid between said compensation tank and said overflow vessel when pressure of said cooling fluid is greater than or equal to a first predetermined pressure level.

16. A circuit as in claim 15 further comprising a heat exchanger thermally coupled between said x-ray imaging tube vessel and said x-ray imaging tube coolant volume control system.

17. A circuit as in claim 16 further comprising a coolant pump circulating said cooling fluid between said x-ray imaging tube vessel and said heat exchanger.

18. A method of compensating for a change in volume of a cooling fluid within an x-ray imaging tube comprising:

enabling the cooling fluid to expand within a compensation tank of an x-ray imaging tube cooling circuit; and enabling flow of the cooling fluid between said compensation tank and an overflow vessel when pressure of the cooling fluid is greater than or equal to a first predetermined value.

19. A method as in claim 18 preventing operation of at least a portion of an x-ray imaging system when pressure of the cooling fluid is greater than or equal to a second predetermined value.

20. A method as in claim 18 further comprising relieving pressure of a relief fluid within at least one of said compensation valve and said overflow vessel.

* * * * *